United States Patent [19]

Brüssel

[11] Patent Number: 4,921,419

[45] Date of Patent: May 1, 1990

[54] HYDRAULIC PRESS

[75] Inventor: Richard Brüssel, Sulzfeld, Fed. Rep. of Germany

[73] Assignee: Fried. Krupp Gesellschaft mit beschränkter Haftung, Essen, Fed. Rep. of Germany

[21] Appl. No.: 310,458

[22] Filed: Feb. 15, 1989

[30] Foreign Application Priority Data

Feb. 18, 1988 [DE] Fed. Rep. of Germany ..... 3805004

[51] Int. Cl.[5] ..... B30B 15/16

[52] U.S. Cl. ..... 425/406; 100/259; 100/260; 425/450.1; 425/451.2; 425/DIG. 47

[58] Field of Search ..... 100/258 A, 259, 260, 100/269 R; 264/40.5, 40.7; 425/107, 406, 408, 450.1, 451, 451.2, 589, 590, DIG. 47

[56] References Cited

U.S. PATENT DOCUMENTS

| | | | |
|---|---|---|---|
| 2,113,115 | 4/1938 | MacMillin et al. | 425/451.2 |
| 2,809,542 | 10/1957 | Albers | 100/258 A |
| 3,997,286 | 12/1976 | Gabrys | 425/406 |
| 4,055,205 | 10/1977 | Withoff et al. | 425/DIG. 47 |

*Primary Examiner*—Jay H. Woo
*Assistant Examiner*—C. Scott Bushey
*Attorney, Agent, or Firm*—Spencer & Frank

[57] ABSTRACT

A hydraulic press includes a press plate mounted for executing working strokes and return strokes; a hydraulic countersupport braking cylinder supported at an end zone of the working stroke for engaging the press plate at an end portion of the working stroke to cause deceleration of the press plate by the hydraulic countersupport braking cylinder; and a hydraulic shock absorber connected between the press plate and the hydraulic countersupport braking cylinder. The hydraulic shock absorber is arranged for compression from an expanded state by the press plate in an end zone of the working strokes. The hydraulic shock absorber has a shock absorber chamber containing hydraulic fluid; a throttle for setting a braking force in the shock absorber chamber to a magnitude smaller than the braking force of the hydraulic countersupport braking cylinder; and a resetting arrangement for returning the shock absorber into its expanded state.

13 Claims, 1 Drawing Sheet

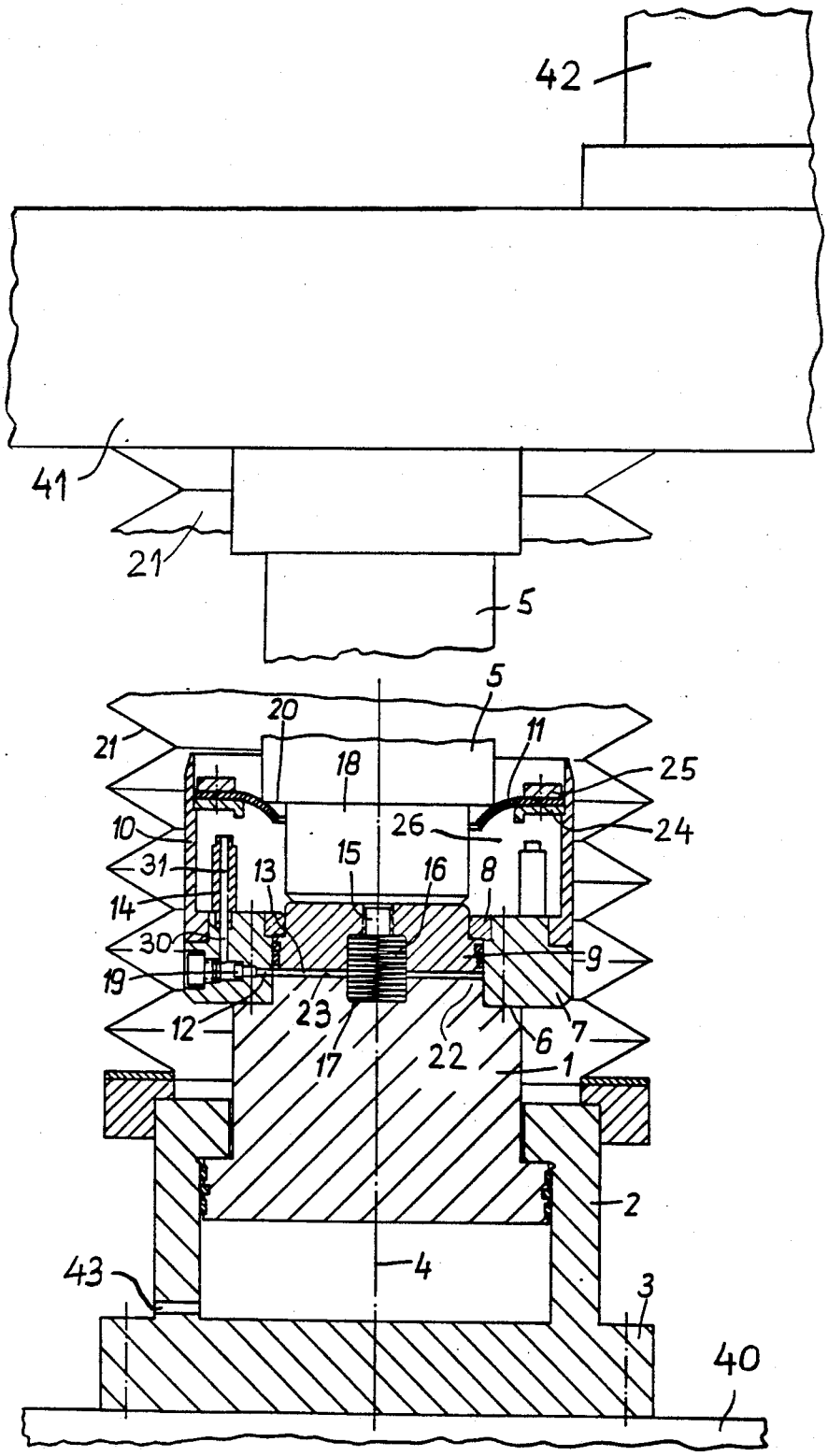
42
41
21
5
5
20
21
18
11
25
10
26
24
31
13
15
16
8
14
30
9
19
23
12
17
22
6
7
1
2
43
4
3
40

HYDRAULIC PRESS

CROSS REFERENCE TO RELATED APPLICATION

This application claims the priority of Federal Republic of Germany Application No. P 38 05 004.8 filed Feb. 18th, 1988, which is incorporated herein by reference.

BACKGROUND OF THE INVENTION

1. Field of the Invention

The present invention relates to a device for braking the movable press plate and the plunger in a hydraulic press employed particularly for the mold-pressing of fiber reinforced synthetic materials. The press plate is guided laterally and includes spindles (abutment members) attached thereto which act on and are braked by at least two countersupport cylinder units mounted on the stationary press table or the press stand.

2. Description of the Prior Art

In hydraulic presses used for processing fiber reinforced plastics, it is necessary that the two tool halves move with a high-precision alignment relative to one another during the pressing process. Such precise movement cannot be realized with the prior art mechanical guides.

Presses have therefore been developed in which, after the driven plunger moves the press plate with a rapid closing speed, countersupport cylinder units brake the plunger and the press plate while simultaneously aligning the final pressing movement of the press plate. When mold-pressing fiber reinforced plastics, such presses encounter a problem in that the highly reactive resin mats to_be processed permit only a very short period of time for the material to dwell without pressure in the heated lower tool portion. Therefore, the time from insertion of the material to closing of the press must be kept as short as possible. Consequently, extremely high speeds have been employed for closing the press, e.g. up to 1 m/s. In practice this speed cannot be increased any further because it would incur excessive additional costs. Further, before the press plate is connected with the countersupport cylinder units, the velocity of the press plate must be reduced to almost zero so as to permit a force-transmitting and/or form-locking connection between the spindles mounted on the press plate and the countersupport units mounted on the press stand. This occurrence, however, may involve such a delay that the advantages of a rapid closing are lost.

SUMMARY OF THE INVENTION

It is an object of the present invention to provide an improved braking device of the above-mentioned type which considerably reduces the loss of time during connection of the spindles (abutment members) with their associated countersupport cylinder units.

This object and others to become apparent as the specification progresses, are accomplished by the invention, according to which, briefly stated, a resettable hydraulic shock absorber disposed between a respective spindle and the countersupport cylinder unit produces a braking effect on the press plate and plunger and this braking force is lower than the braking force of the countersupport cylinder unit.

The device according to the invention can be employed in various hydraulic press systems operating with countersupport cylinder units. It not only provides the advantage of a rapid connection of the spindle and the associated countersupport cylinder unit and effective braking of plunger and the press plate, but it also contributes to a reduction in the noise of the hydraulic press during its operation.

Additionally, shocks caused by the impact of the press plate on the countersupport cylinder unit are reduced considerably. However, the primary advantage of the invention is that the speed of the plunger, the press plate and the spindle, before the spindle impacts on the piston of the countersupport cylinder unit, needs to be reduced much less than in the prior art devices. Further, the speed of the damping or braking stroke is still sufficiently high to maintain the loss of time at a minimum for the subsequently required acceleration of the press plate.

In presses in which the countersupport cylinder units simultaneously serve to open the pressing tool parts after the pressing process, this function is in no way impeded by the device according to the present invention.

BRIEF DESCRIPTION OF THE DRAWING

The sole FIGURE is a sectional elevational view illustrating a preferred embodiment of the invention.

DESCRIPTION OF THE PREFERRED EMBODIMENT

The sole FIGURE illustrates in section a countersupport cylinder unit which includes a countersupport cylinder 2 having a flanged end 3 and a piston 1 having one end disposed in the countersupport cylinder 2. The flanged end 3 is connected by means of screws (only symbolically illustrated by dash-dot lines) and by way of a height-adjustable device (not shown) with a press table 40 of a hydraulic press. Generally, four such countersupport cylinder units are arranged in such a manner that their respective vertical axes 4 are disposed in the form of a rectangle outside of the range of the pressing tool parts.

The hydraulic press has a vertically movable press plate 41 which is actuated by one or more plungers (piston rods) 42 of press cylinder units of the hydraulic press and which is provided with respective downwardly projecting, height-adjustable stepped abutment members 5, each being height-adjustable —for example, by means of a threaded spindle (not shown)—for adaptation to different height positions.

At its end which projects out from the countersupport cylinder 2, the piston 1 has a stepped cylindrical end 22 forming a shoulder 6. An annular cylinder 7 is screwed in a sealing manner onto the end 22. That end of the cylinder 7 which is oriented away from the piston 1 is provided with an inwardly oriented flange 8 which limits the upward stroke of a damping piston 9 axially slidably received in the cylinder 7. The flange 8 is an externally threaded ring whose axial position with respect to the cylinder 7 may be changed by turning the ring, thus varying the stroke length (and thus the throttling effect) of the damping piston 9. The cylinder 7, the damping piston 9 and the upper radial surface 23 of the piston 1 form a shock absorber which will be described in further detail below.

The cylinder 7 is provided with an upwardly extending, sleeve-shaped cylindrical attachment 10 which has the same outer diameter as the cylinder 7. In the upper region of the cylindrical attachment 10, a flat annular seal 11 is provided which is mounted to the attachment 10 between elements 24 and 25 and which serves for preventing hydraulic fluid from escaping from the volume 26 enclosed by the cylindrical attachment 10, the damping piston 9 and the annular seal 11. The volume 26 acts as a reservoir for the hydraulic fluid of the shock absorber. The lower, stepped portion 18 of the abutment member 5 has approximately the same diameter as the outwardly projecting end of the damping piston 9 and the upper end of portion 18 forms a shoulder 20 of the abutment 5 against which the annular seal 11 lies when the abutment 5 contacts the damping piston 9. The cylinder 7 is provided with three radial bores 12 (only one is visible) which open into a relatively narrow clearance 13 formed between piston 1 and the damping piston 9 when the damping piston is in the extended or upper position. The width of the clearance 13 when the damping piston 9 is in its upper position and which corresponds to the stroke of the shock absorber, is about 5 mm. Further the damping piston diameter is about 80 mm, and this, together with the length of the stroke (height of the gap 13), determines the volume of hydraulic fluid that is displaced when the damping piston 9 is forced into contact with the upper surface 23 of the piston end 22.

Each bore 12—throttled at the lateral face of the cylinder 7 by a respective nozzle plug 19—communicates with an axially parallel port 30 provided in the cylinder 7 and an adjoining passage 31 provided in an upwardly oriented nipple 14, projecting beyond the upper radial face of the cylinder 7. The nipples 14 are disposed on the cylinder 7 so that passages 31 are located vertically below the annular element 24.

The damping piston 9 is provided with a central, stepped bore 15 in which a helical compression spring 16 is disposed and seated in a blind bore 17 formed in the piston 1.

The piston 1 and the damping piston 9 are shown in their upper, extended positions. When the stepped abutment member 5 moves downwardly, towards its illustrated position, the lower cylindrical part 18 of the abutment member 5 impacts on the upper surface of the damping piston 9 at the end of the rapid closing motion of the press plate. Since the force of the countersupport cylinder unit is set so that its force is greater than the damping force of the shock absorber 7, 9, the hydraulic fluid disposed in gap 13 is displaced through bores 12, 30 and 31 into the interior volume 26 of attachment 10 until the damping piston 9 abuts the upper surface 23 of the piston 1. When this occurs, the braking effect of the shock absorber is no longer present and the braking function is assumed by the countersupport cylinder unit, for example, by hydraulic fluid being displaced from the cylinder 2 through a throttle 43 in a known manner into a reservoir (not shown).

Thus, the countersupport cylinder unit, contrary to prior art constructions, does not have to be set to its maximum holding force to counteract the abutment member 5 as it strikes the damping piston 9.

In order to adapt the shock absorber to various operating conditions, the damping force of the shock absorber may also be varied—in addition to or instead of the adjustable flange 8—in a simple manner by using exchangeable nozzles 19 which have different inner diameters (and thus different throttling effects) and which are screwed into the bores 12.

Upon completion of the downward pressing stroke, the press plate moves rapidly back into its upper end position, carrying with it the abutment member 5. This allows the helical spring 16 to push the damping piston 9 back into its upper position and the oil which was displaced from the gap 13 is now able to flow back into the gap 13 through the central bore 15.

An expansion bellows 21 surrounding the shock absorber is provided between the countersupport cylinder 2 and the press plate 41 so as to seal off the shock absorber from leaking any fluids near the press tool parts and from being contaminated from any material present in and around the press.

It will be understood that the above description of the present invention is susceptible to various modifications, changes and adaptations, and the same are intended to be comprehended within the meaning and range of equivalents of the appended claims.

What is claimed is:

1. In a hydraulic press including a press plate mounted for executing working strokes and return strokes;

hydraulic power means connected to said press plate for driving said press plate in execution of said working strokes;

a hydraulic countersupport braking cylinder means supported at an end zone of the working stroke for operatively engaging said press plate at an end portion of the working stroke to cause deceleration of the press plate by said hydraulic countersupport braking cylinder means;

the improvement comprising a hydraulic shock absorber having an expanded state and a compressed state; said hydraulic shock absorber being interposed between said press plate and said hydraulic countersupport braking cylinder means, whereby said hydraulic shock absorber is moved from the expanded state into the compressed state by said press plate in an end zone of said working strokes; said hydraulic shock absorber having (a) means defining a shock absorber chamber containing hydraulic fluid;

(b) throttle means for setting a braking force in said shock absorber chamber to a magnitude smaller than a braking force of said hydraulic countersupport braking cylinder means; and (c) resetting means for returning said shock absorber into said expanded state.

2. A hydraulic press as defined in claim 1, further comprising an abutment member mounted on the press plate and extending therefrom in a direction of the working strokes; said hydraulic countersupport braking cylinder means including a countersupport cylinder and a countersupport piston received in said countersupport cylinder; and said hydraulic shock absorber having a damping piston bounding said shock absorber chamber.

3. A hydraulic press as defined in claim 1, further comprising means for adjusting said throttle means.

4. A hydraulic press as defined in claim 2, wherein said hydraulic shock absorber is mounted on said countersupport piston in alignment with said abutment member.

5. A hydraulic press as defined in claim 2, wherein said resetting means comprises a spring contacting said damping piston.

6. A hydraulic press as defined in claim 2, wherein said damping piston has an axial throughgoing bore.

7. A hydraulic press as defined in claim 2, wherein said damping piston has an axial stroke length, further comprising means for changing said axial stroke length.

8. A hydraulic press as defined in claim 2, wherein said shock absorber cylinder is an axially bilaterally open annular member affixed to said countersupport piston in axial alignment therewith; said shock absorber cylinder having a radially inwardly oriented retaining flange situated at an axial distance from said countersupport piston and limiting an axial stroke length of said damping piston.

9. A hydraulic press as defined in claim 8, further wherein said retaining flange is an annulus threadedly received in said shock absorber cylinder, whereby the axial position of said retaining flange is variable relative to said shock absorber cylinder for altering said axial stroke length.

10. A hydraulic press as defined in claim 8, wherein said damping piston and said countersupport piston have respective, axially aligned end faces oriented toward one another, and said shock absorber cylinder has an inner cylinder face; said means defining said shock absorber chamber comprising said end faces and said inner cylinder face.

11. A hydraulic press as defined in claim 10, wherein said resetting means comprises a compression spring positioned between and in contact with said damping piston and said countersupport piston.

12. A hydraulic press as defined in claim 10, further comprising a cylindrical, sleeve-shaped attachment affixed to said shock absorber cylinder coaxially therewith; said attachment projecting axially in a direction away from said countersupport piston and defining an open reservoir adjacent said damping piston; said abutment member being situated within said reservoir upon its engagement with said damping piston; further comprising a port provided in said shock absorber cylinder; said port maintaining hydraulic communication between said shock absorber chamber and said reservoir; said throttle means being disposed in said port.

13. A hydraulic press as defined in claim 12, further comprising a flat annular seal affixed to said attachment coaxially therewith and bounding said reservoir; said abutment member, upon its engagement with said shock absorber piston, projecting through said flat annular seal and being circumferentially sealed thereby.

* * * * *